US005581822A

United States Patent [19]

Tagyo

[11] Patent Number: 5,581,822

[45] Date of Patent: Dec. 10, 1996

[54] SWIMMING GOGGLE

[76] Inventor: Akiko Tagyo, Suite 1001, 3-11 Nakameguro 1-chome, Meguro-ku, Tokyo 153, Japan

[21] Appl. No.: 485,990

[22] Filed: Jun. 7, 1995

[30] Foreign Application Priority Data

Jul. 6, 1994 [JP] Japan ..... 6-009238 U
Mar. 9, 1995 [JP] Japan ..... 7-6664

[51] Int. Cl.[6] ..... A61F 9/02

[52] U.S. Cl. ..... 2/428; 2/452

[58] Field of Search ..... 2/428, 429, 430, 2/439, 440, 452, 447; 128/858, 206.23; 351/154

[56] References Cited

U.S. PATENT DOCUMENTS 583,590 6/1897 Bennett ..... 2/447
2,568,316 9/1951 Brown ..... 2/428
2,777,129 1/1957 Hummel ..... 128/206.23
4,649,908 3/1987 Ghaly ..... 128/858
4,799,781 1/1989 Weber ..... 351/154 X
4,910,806 3/1990 Baker et al. ..... 2/452

FOREIGN PATENT DOCUMENTS 3107718 7/1993 Japan .
390430 5/1994 Japan .
483151 5/1994 Japan .

*Primary Examiner*—Peter Nerbun
*Attorney, Agent, or Firm*—Ladas & Parry

[57] ABSTRACT

A swimming goggle which has an attractive appearance, good watertight properties and which is rather small is disclosed. A single lens formed of a substantially rigid transparent material covers both eyes and has a smooth rearwardly curved front surface so as to minimize resistance and not prevent one from swimming fast. Two watertight elastic members shaped to fit around a user's eyes are mounted on a rear surface of the lens so as not to extend substantially beyond the edges of the lens. A band is attached at opposite ends of the lens.

14 Claims, 3 Drawing Sheets

SWIMMING GOGGLE

BACKGROUND OF INVENTION

This invention relates to swimming goggles and more particularly to goggles not only used for swimming races, but also used for other sports like surfing, water-skiing, and so on.

Swimming goggles are used for protecting eyes and for seeing better in water. There are various types of goggles which vary in appearance. Goggles used for diving have the appearance of relatively big lenses surrounded by rubber frames for achieving a wide range of vision. On the other hand, goggles used for swimming races have the appearance of two relatively small interconnected egg-shaped lenses made of glass or of a resin which minimize resistance so as not to prevent one from swimming faster. These goggles for swimming races are popularly used by ordinary swimming fans and other marine sports fans.

In such a device of the prior art, the appearance of goggles used for swimming races has not been good. The goggle covers the eyes with two egg-shaped lenses, giving the impression of two big frames in front of the face. The appearance is funny and is similar to that of old fashioned spectacles. Because of the small size of the lenses, a flat portion projects from the center of each lens to provide undistorted views. As a result, the goggle looks as though it projects out of the face.

If lenses which are divided into right and left portions were to be unified, the appearance of the goggle would be attractive and smart. But then the problem of whether such a goggle would have a sufficiently watertight property would arise. A swimming goggle of the above mentioned prior art type achieves a watertight fit with two small lenses and elastic members like rubber which are secured on the edges of the lenses and press a face around the eyes. Securing an elastic member along the edge of the unified single lens mentioned above not only makes the goggle big in appearance, but also makes it difficult to get a good watertight fit behind the lens because of the difficulty in making an elastic member secured to the edge of the lens which is capable of fitting various shapes of faces.

It is an object of the invention to provide a goggle which is stylish and attractive.

Another object of the invention is to provide a goggle which has a good watertight property.

A further object of the present invention is to provide a goggle which has a smooth lens surface, and is relatively small so as to minimize resistance and not prevent one from swimming faster.

BRIEF DESCRIPTION OF THE DRAWINGS

These and other objects as well as advantages of the present invention will become clear by the following description of a preferred embodiment of the present invention with reference to the accompanying drawings, wherein.

DESCRIPTION OF INVENTION

Figure 1:
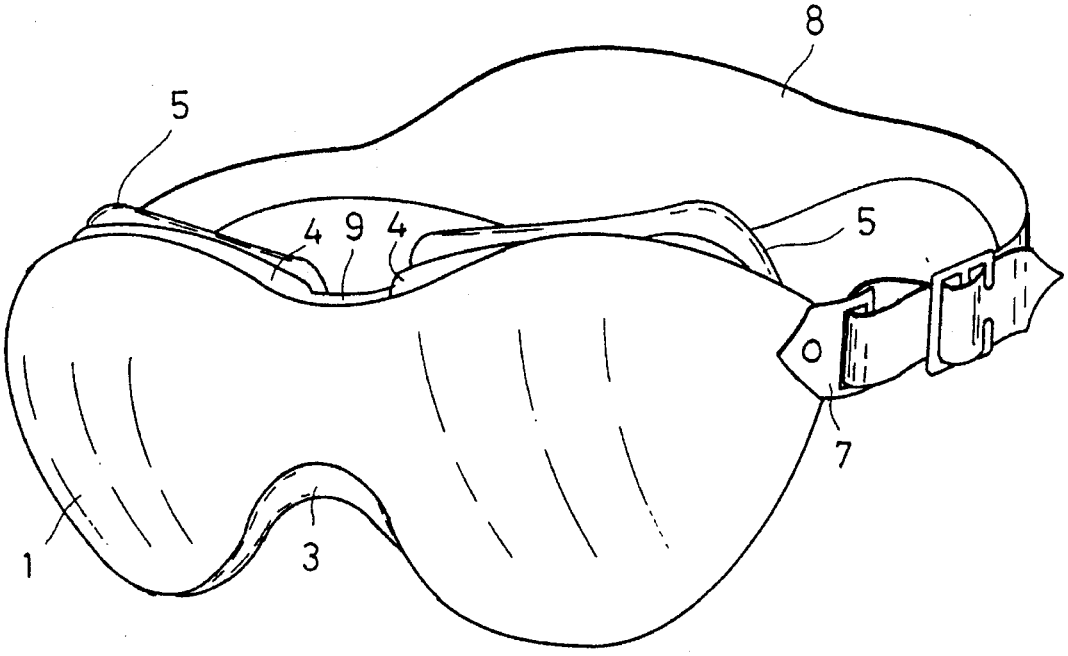
FIG. 1 is a perspective view of a preferred embodiment of the swimming goggle of the present invention.
Figure 2:
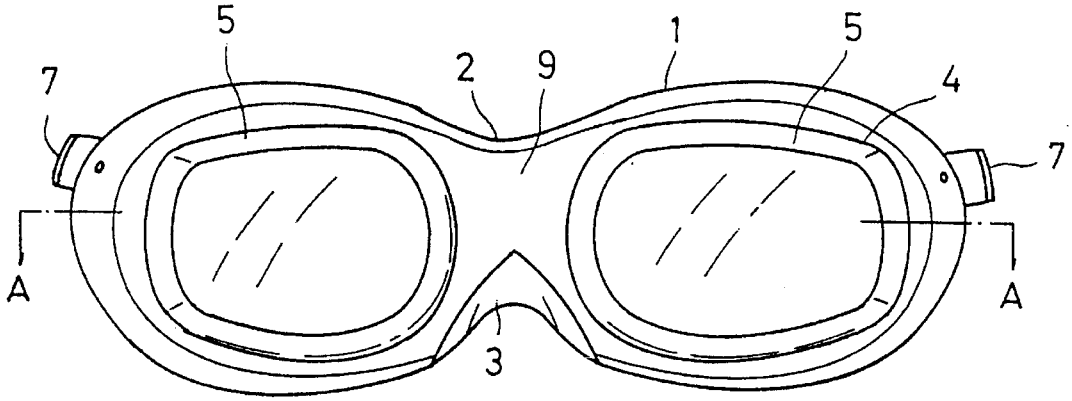
FIG. 2 is a rear elevational view of the swimming goggle of FIG. 1.
Figure 3:
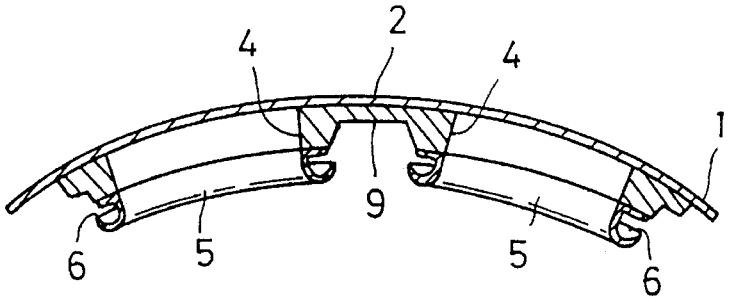
FIG. 3 is a cross-sectional view of the goggle taken along line A—A of FIG. 2.

Referring first to the embodiment of the invention shown in FIG. 1–3, the swimming goggle has a single lens 1 having a smooth rearwardly curved front surface. The lens 1 is made of a substantially rigid transparent material, such as a polycarbonate which is colored by compounding a coloring material while retaining the transparency of the resin. The front surface of lens 1 is half-mirror coated to make the front surface reflective but allows the wearer to see through the lens 1 from the rear surface. The reflective front surface of lens 1 makes it difficult to see through the goggle from the front surface. The lens may be made of other resins like polyethylene or polyester or may be made of tempered glass. Lens 1 has two portions covering corresponding eyes and has a pinched-in bridge portion between said two portions which cover the eyes. The lens 1 is essentially figure-8 shaped. The lens 1 is spherically shaped and is rearwardly curved to fit a surface of a wearer's forehead and cheeks. The smooth front spherical surface of lens 1 is attractive and minimizes resistance so as not to prevent one from swimming fast. A reversed U-shaped thick pad 3 which rests on a wearer's nose is secured on the lower edge of said bridge portion 2.

Two ring-shaped projecting portions 4 are mounted on the right and the left on the rear surface of the lens 1. The lens 1 and the two projecting portions 4 may be molded together. But in this embodiment, the projecting portions 4 are molded separately from the lens 1. The two ring-shaped projecting portions 4 are connected to each other by a connecting portion 9 to form a figure 8-like configuration, and these connected ring-shaped projecting portions 4 are secured at the rear of the lens 1. The two ring-shaped projecting portions 4 are separately located on the right and the left sides of said bridge portion 2 and correspond to respective eyes when the goggle is being worn.

A ring-shaped elastic member 5 is secured on a ridge of each projecting portion 4. The elastic member 5 is made of carbon-rubber, and has a flange 6 having a tip which is bent outwardly of the ring-shaped elastic member 5. Spongy foam rubber or silicon rubber also may be used as materials to form elastic member 5. When the goggle is being worn, the ring-shaped elastic members 5 are in contact with only the forehead and cheeks around the eyes and do not rest on the nose, so that the elastic members fit closely against a face irrespective of the various shapes and sizes of noses. Ring-shaped elastic members 5 are secured at the rear of the lens 1 and do not extend beyond the edge of the lens, so that the appearance of the goggle is rather small. In other words the elastic members 5 are shaped to fit around the user's eyes but not to extend substantially beyond the edges of the lens 1.

The two ring-shaped projecting portions 4 are not required and in a modified embodiment of the invention, the two ring-shaped elastic members 5 are directly secured to the rear surface of the lens 1.

Buckles 7 are respectively removably secured to each end of lens 1 and a band 8 is attached to lens 1 by passing opposite ends through said buckles 7.

When the goggle is being worn, the band 8 is placed around the back of the user's head and lens 1 covers both eyes. Both elastic members 5 touch and press against the user's face around the eyes for a good watertight seal in the spaces between lens 1 and the eyes.

Figure 4:
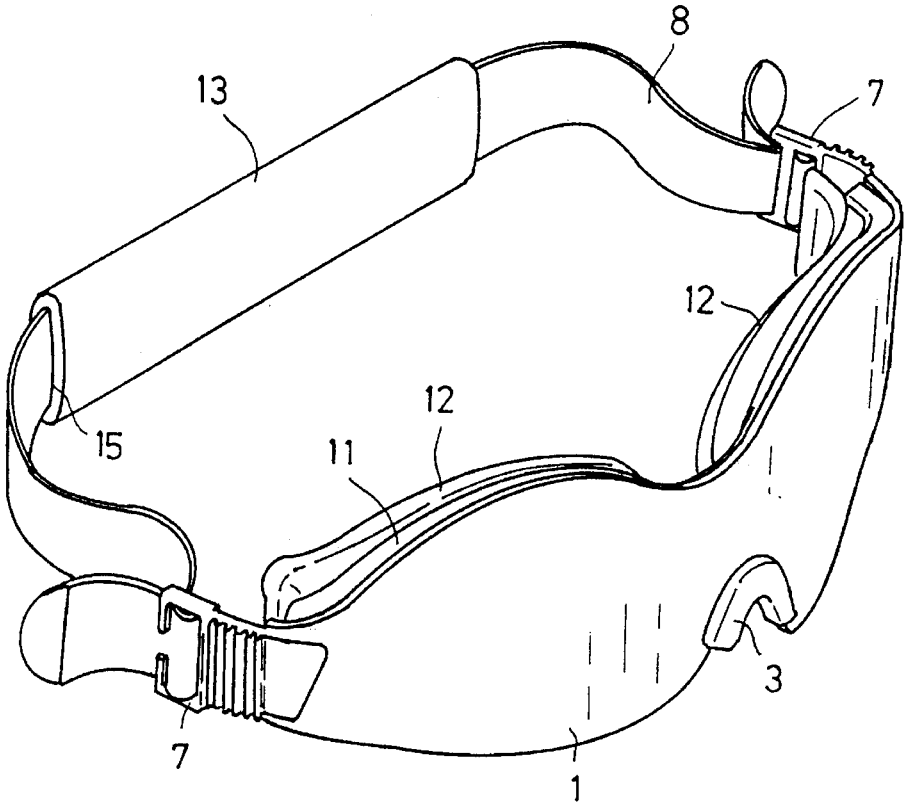
FIG. 4 is a perspective view of a further preferred embodiment of the swimming goggle of the present invention.
Figure 5:
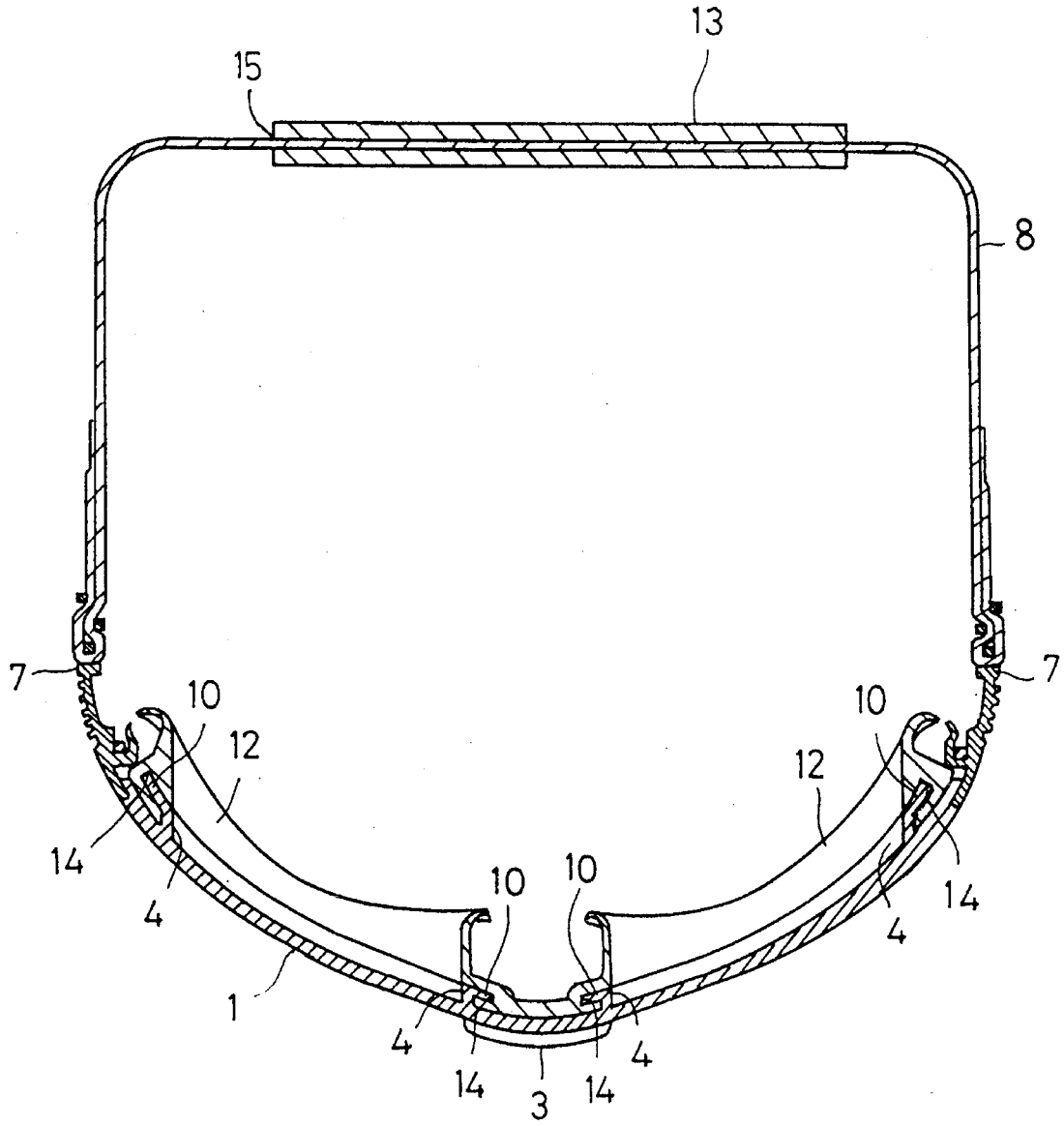
FIG. 5 is a top cross-sectional view Of the swimming goggle shown in FIG. 4.

FIG. 4 and 5 illustrate another modified embodiment of the invention in which a lens 1 forms a cylindrical smooth rearwardly curved front surface. Two ring-shaped projecting portions 4 are mounted on the rear surface of the lens 1 and each ring-shaped projecting portion 4 has an outwardly curved flange 10.

In this embodiment, a single elastic member 11 is mounted on the rear surface of the lens 1. The elastic member 11 has two ring-shaped projecting portions 12 having outwardly curved ridges. Two ring-shaped grooves 14 are formed on the surface of the elastic member 11. The elastic member 11 is attached to the rear surface of lens 1 by engaging grooves 14 of the elastic member 11 with said flanges 10 of the projecting portions 4 of the lens 1.

Buckles 7 are respectively removably secured to each end of lens 1 and a band 8 is attached to lens 1 by passing opposite ends through said buckles 7.

A cylindrical floating member 13 made of foam rubber is attached in the middle of the band 8 by passing the band 8 through a space 15 in the floating member 13. Since the floating member 13 floats on water because the specific gravity of foam rubber is small, the goggle does not sink into the water.

While the invention has been particularly shown and described with reference to preferred embodiments thereof, it will be understood by those skilled in the art that the foregoing and other changes in form and details, for example, inscribing patterns on the edge of the lens, can be made therein without departing from the spirit and scope of the invention.

What is claimed is:

1. A swimming goggle comprising a single lens formed of a substantially rigid transparent material and having a smooth rearwardly curved front surface, two watertight elastic members shaped to fit around a user's eyes and mounted on a rear surface of the lens but not to extend substantially beyond the edges of the lens, said elastic members having sufficient thickness rearwardly of said lens to cause the rear surface of the lens to be spaced from the user's face, and a band attached adjacent opposite ends of the lens for holding the goggle to the user's head.

2. A swimming goggle as claimed in claim 1 in which the lens is made of a resin.

3. A swimming goggle as claimed in claim 1 in which the lens is made of tempered glass.

4. A swimming goggle as claimed in claim 1 in which the lens is mirror-coated on the front surface.

5. A swimming goggle as claimed in claim 1 in which a floating member is attached in the middle of the band.

6. A swimming goggle according to claim 1, in which the rear surface of the lens has watertight rearward projections onto which the elastic members fit.

7. A swimming goggle as claimed in claim 6 in which the lens is made of a resin.

8. A swimming goggle as claimed in claim 6 in which the lens is made of tempered glass.

9. A swimming goggle as claimed in claim 6 in which the lens is mirror-coated on the front surface.

10. A swimming goggle as claimed in claim 6 in which the floating member is attached in the middle of the band.

11. A swimming goggle as claimed in claim 2, in which the lens is made of a polycarbonate, a polyester or a polyethylene.

12. A swimming goggle as claimed in claim 7, in which the lens is made of a polycarbonate, a polyester or a polyethylene.

13. A swimming goggle as claimed in claim 1, in which the lens has a spherically curved front surface.

14. A swimming goggle claimed in claim 6, in which the lens has a spherically curved front surface.

* * * * *